US011306588B2

(12) United States Patent
Meng et al.

(10) Patent No.: US 11,306,588 B2
(45) Date of Patent: Apr. 19, 2022

(54) METHOD OF TREATING TUNNEL COLLAPSE USING PAVILION SUPPORT

(71) Applicants: SHANDONG UNIVERSITY OF SCIENCE AND TECHNOLOGY, Qingdao (CN); CHINA COMMUNICATIONS CONSTRUCTION CO., LTD, Beijing (CN); QINGDAO WEST COAST RAIL TRANSIT CO., LTD, Qingdao (CN); QINGDAO FIRST MUNICIPAL ENGINEERING CO., LTD, Qingdao (CN); HEBEI FEIPU ENVIRONMENTAL PROTECTION TECHNOLOGY CO., LTD, Shijiazhuang (CN)

(72) Inventors: Xianghui Meng, Qingdao (CN); Shibin Jiang, Qingdao (CN); Weizhou Li, Qingdao (CN); Hailiang Wang, Qingdao (CN); Fu Yu, Qingdao (CN); Wensheng He, Qingdao (CN); Quanwei Liu, Qingdao (CN); Chuan Li, Qingdao (CN); Zhenbiao Wang, Qingdao (CN); Lin Xin, Qingdao (CN); Biao Kong, Qingdao (CN); Xiangbao Meng, Qingdao (CN); Yong Zhang, Qingdao (CN); Wenming Zhang, Qingdao (CN); Lide Hou, Qingdao (CN); Jiufang Xiong, Qingdao (CN); Xuanshan Zhang, Qingdao (CN)

(73) Assignees: SHANDONG UNIVERSITY OF SCIENCE AND TECHNOLOGY, Qingdao (CN); CHINA COMMUNICATIONS CONSTRUCTION CO., LTD., Beijing (CN); QINGDAO WEST COAST RAIL TRANSIT CO., LTD., Qingdao (CN); QINGDAO FIRST MUNICIPAL ENGINEERING CO., LTD, Qingdao (CN); HEBEI FEIPU ENVIRONMENTAL PROTECTION TECHNOLOGY CO., LTD, Shijiazhuang (CN)

( * ) Notice: Subject to any disclaimer, the term of this patent is extended or adjusted under 35 U.S.C. 154(b) by 0 days.

(21) Appl. No.: 17/292,152

(22) PCT Filed: Jul. 20, 2020

(86) PCT No.: PCT/CN2020/102909
§ 371 (c)(1),
(2) Date: May 7, 2021

(87) PCT Pub. No.: WO2021/179507
PCT Pub. Date: Sep. 16, 2021

(65) Prior Publication Data

US 2021/0388724 A1 Dec. 16, 2021

(30) Foreign Application Priority Data

Mar. 11, 2020 (CN) ..... 202010164054.7

(51) Int. Cl.
*E21D 19/00* (2006.01)
*E21D 11/10* (2006.01)
(Continued)

(52) U.S. Cl.
CPC ..... *E21D 11/10* (2013.01); *E21D 11/152* (2013.01); *E21D 11/18* (2013.01); *E21D 15/44* (2013.01)

(58) Field of Classification Search
CPC ..... E21D 19/00; E21D 19/04; E21D 11/10; E21D 11/105; E21D 11/152; E21D 11/15; E21D 11/18
See application file for complete search history.

(56) References Cited

FOREIGN PATENT DOCUMENTS

CN 106545351 B 7/2018
CN 104989434 B 8/2018
(Continued)

OTHER PUBLICATIONS

First Office Action issued in corresponding Chinese Application No. 202010164054.7; dated Oct. 16, 2020; State Intellectual Property Office of the P.R. China, Beijing, China, 8 pgs.
(Continued)

*Primary Examiner* — Sunil Singh
(74) *Attorney, Agent, or Firm* — Hauptman Ham, LLP

(57) ABSTRACT

A method of treating tunnel collapse includes leveling a collapse body and moving a pavilion support under the
(Continued)

collapse cavity, lifting a shield plate until a lower edge of the shield plate surpasses a contour line of an initial supporting arch of a tunnel, connecting a bottom column and inserting a padding plate under a column. If the hydraulic prop retracts, the column, the bottom column, the padding plate and the hydraulic prop bear a load from the shield plate. Mounting and connecting the initial supporting arch, welding the intersection point of the column and the initial supporting arch, cutting off the column in the initial supporting arch. Transferring the load of the shield plate from the pavilion support to an initial supporting shed, spraying fast-setting concrete to a grid arch to form a closed shell, and pumping filling material to fill the space of the collapse cavity.

10 Claims, 6 Drawing Sheets

(51) Int. Cl.

| | |
|---|---|
| ***E21D 11/15*** | (2006.01) |
| ***E21D 11/18*** | (2006.01) |
| ***E21D 15/44*** | (2006.01) |

(56) References Cited

FOREIGN PATENT DOCUMENTS

| | | |
|---|---|---|
| CN | 111365043 A | 7/2020 |
| CN | 111365044 A | 7/2020 |

OTHER PUBLICATIONS

First Search Report issued in corresponding Chinese Application No. 202010164054.7; dated Oct. 10, 2020; State Intellectual Property Office of the P.R. China, Beijing, China, 5 pgs.

Notice of Grant issued in corresponding Chinese Application No. 202010164054.7; dated Nov. 24, 2020; State Intellectual Property Office of the P.R. China, Beijing, China, 4 pgs.

International Search Report issued in corresponding International Application No. PCT/CN2020/102909; dated Oct. 10, 2020; State Intellectual Property Office of the P.R. China, Beijing, China, 9 pgs.

Written Opinion issued in corresponding International Application No. PCT/CN2020/102909; dated Oct. 10, 2020; State Intellectual Property Office of the P.R. China, Beijing, China, 9 pgs.

METHOD OF TREATING TUNNEL COLLAPSE USING PAVILION SUPPORT

RELATED APPLICATIONS

The present application is a U.S. National Phase of International Application Number PCT/CN2020/102909, filed Jul. 20, 2020, and claims the priority of Chinese Application No. 202010164054.7, filed Mar. 11, 2020.

TECHNICAL FIELD

The present disclosure relates to the field of tunnels and underground engineering technologies, and in particular to a method of treating tunnel collapse using a pavilion support.

BACKGROUND

At present, the methods of treating common tunnel collapse accidents mainly include pipe shed method, backfill method, cover arch method, small duct grouting method, and secondary lining reinforcement and the like. In the pipe shed method, a borehole parallel to an axis of a tunnel is drilled along an excavation contour line, and then steel pipes of different diameters are inserted to form a steel pipe shed. In the backfill method, drilling and grouting or filling material backfilling are performed from the ground surface or from inside a tunnel above a collapse cavity. In the small duct grouting method, before a collapse body is excavated, a small duct with a grouting hole is hammered toward a tunnel face at an angle of elevation along a contour line of the tunnel to fill the fissures of the surrounding rocks by grouting and form a combination body with a given thickness, thereby ensuring contour stability of the tunnel.

The patent documents in the prior art:

The patent document 1 provides a method of treating a collapse of a tunneling working face using a penetration pipe combination arch (publication number: CN104989434B), which specifically includes: erecting a ring arch in a safe region, erecting a segmented supporting arch under the protection of steel pipes to realize the technical effect of safe, fast and effective treatment of collapse. However, the following problems still exist: (1) the manual operation of the collapse treatment process has high labor intensity and low working efficiency; (2) the operators in the collapse section are directly exposed under the collapse when erecting the segmented supporting arch in spite of protection of the steel pipes; especially in step 2, an arch top section of the segmented supporting arch in the collapse region will be lifted to higher than the contour line of an initial support of tunnel, and the operators have to be exposed under the collapse cavity, resulting in large potential safety hazards.

The patent document 2 provides an emergency treatment method for collapse of a tunneling working face (publication number: CN106545351B), which specifically includes: continuously supporting two arch beams using a single hydraulic prop in a safe section, forming a bearing point by use of two arch beams supported on the arch top of the safe section, with a position of a collapse region working face into which a wedge beam is wedged as another bearing point. Two bearing points support the wedge beam and a bearing body is placed on the wedge beam, so as to effectively treat collapse. The following problems still exist: (1) low working efficiency: although the working efficiency of the safe section is improved by the single hydraulic prop, manual operations are still required for the key links of the collapse section, thereby resulting in no improvement of the working efficiency; (2) existence of potential safety hazards: although the operators are protected by the wedge beam, the operators still have to be exposed under the collapse cavity when laying the bearing body such as a sleeper, bringing a large potential safety hazard; (3) limitation of effectiveness: the surrounding rocks of the working face of the collapse section are soft rocks, resulting in instability of bearing points; or, when the surrounding rocks of the working face of the collapse section are hard rocks, the wedge top beam cannot be wedged into the surrounding rocks of the working face to form a bearing point. In these two circumstances, the technical solution recorded herein cannot be achieved, and thus the anticipated technical effect cannot be realized.

Further, when the single hydraulic prop is used, if the single hydraulic prop cannot contact a roof in time, a supporting force cannot be exerted onto the roof. When the roof of the collapse cavity collapses, because pressure abruptly acts on the single hydraulic prop at the instant of collapse, the hydraulic oil of the single hydraulic prop cannot be discharged in time, resulting in cylinder explosion accident, that is, the oil cylinder of the single hydraulic prop is instantaneously deformed or cracked under the impact pressure. In this case, higher requirements are made to the strength and rigidity of the single hydraulic prop to withstand the possible instantaneous impact pressure. In a case of use of a single hydraulic prop, the stroke of the single hydraulic prop cannot satisfy the requirements of lifting height of the shield plate, and especially in a case of a large depth of collapse cavity, there is a case that it is difficult for the hydraulic prop to contact the roof.

SUMMARY

In order to solve the problems of the prior art in treatment of tunnel collapse, the present disclosure provides a method of treating tunnel collapse using a pavilion support. The method is applicable to a case that a collapse cavity is relatively stable, large in cavity height and difficulty in contacting of a hydraulic prop with roof, and solves the problems of higher requirements of stability of shield plate support for strength and rigidity of the hydraulic prop, cylinder explosion possibly resulting from unexpected collapse of a collapse position, and smooth transfer of load of a shield plate to an initial supporting shed. The specific technical solution is described below:

A method of treating tunnel collapse using a pavilion support is provided, including the following steps:

at step 1, mounting a pavilion support structure, comprising an assembly base, a shield plate, a column, a longitudinal canopy, and a transverse canopy, wherein the longitudinal canopy and the transverse canopy are fixed on the shield plate, and the column is fixed between the base and the shield plate;

at step 2, leveling a collapse body under a collapse cavity to form a platform, and placing the pavilion support structure on the platform;

at step 3, inserting a hydraulic prop into a bottom prop groove on the base under the protection of the shield plate, lifting the hydraulic props to enable each hydraulic prop to be fitted with the longitudinal canopy or the transverse canopy;

at step 4, disconnecting the column and the base, and continuing lifting the hydraulic prop smoothly until a lower edge of a top prop groove is higher than an contour line of an initial supporting arch;

at step 5, mounting a bottom column, firstly fixing a lower connection plate of the column and an upper connection plate of the bottom column and then inserting a padding plate between the bottom column and the base;

at step 6, erecting the initial supporting arch under the shield plate, and fixedly connecting an original supporting structure in a tunnel and the initial supporting arch under the shield plate to form an initial supporting shed;

at step 7, removing the hydraulic prop, mounting an air discharge pipe and a filling material pumping pipe on the shield plate, and laying an anchor net under the initial supporting arch;

at step 8, spraying concrete onto the initial supporting arch, and after setting of the concrete, pumping filling material into the collapse cavity and discharging air in the collapse cavity with the air discharge pipe until the collapse cavity is filled up with filling material.

Preferably, in step 1, a top prop groove is disposed on the shield plate and the bottom prop groove is disposed on the base, the top prop groove and the bottom prop groove are oppositely disposed; the longitudinal canopy and the transverse canopy are mounted in the top prop groove; and the longitudinal canopy and the transverse canopy each are provided with a toothed groove engaged with a top cover of the hydraulic prop.

Further preferably, one or more groups of penetration holes are disposed on the shield plate, each group of penetration holes includes one filling material pumping pipe penetration hole and one air discharge pipe penetration hole; a bottom steel plate is provided with a bolt for mating with a bolt hole on the lower connection plate of the column.

Further preferably, at step 2, the collapse body under the collapse cavity is leveled by an excavator, and the pavilion support structure is moved onto the platform by the excavator; or, the pavilion support structure is fixed on a motor vehicle which then is driven onto the platform under the collapse cavity with a driver cab of the motor vehicle being in a safe region outside the collapse cavity.

Further preferably, at step 3, a single hydraulic prop or a hydraulic jack is selected as the hydraulic prop, the bottom of the hydraulic prop is fixed in the bottom prop groove of the base by a pin or insertion plate, and the top of the hydraulic prop is fitted with the toothed groove of the longitudinal canopy or the transverse canopy.

Further preferably, at step 4, after the column and the base are disconnected, the shield plate and the upper connection plate of the column are still in connection and moved up along with the hydraulic prop.

Further preferably, at step 5, after the padding plate is inserted, when the hydraulic prop retracts under load, the column, the bottom column, the padding plate and the hydraulic prop jointly bear a load transferred from the shield plate.

Further preferably, in step 6, when the hydraulic prop occupies a mounting position of the initial supporting arch, an alternative hydraulic prop is firstly erected at the position adjacent to the single hydraulic prop and the hydraulic prop occupying the mounting position of the initial supporting arch is then dismounted.

Further preferably, when the column occupies a mounting position of the initial supporting arch, the column and the adjacent initial supporting arch are welded together and a part of the column invading into the initial supporting arch is cut off, and then the initial supporting arch is then erected at the position of cutting the column, and the cutting point of cutting off the column and the initial supporting arch are welded together; and after the initial supporting shed is formed, the load of the shield plate is transferred from the pavilion support to the initial supporting shed.

Further preferably, a side baffle plate is disposed at a side wing of the shield plate and hinged with the shield plate, and the hydraulic prop disposed on the shield plate or the base controls the side baffle plate to be movable.

The method of treating tunnel collapse using a pavilion support according to the present disclosure has the following beneficial effects: the pavilion support is used to provide a safe working space for operations under the collapse cavity, and each step is performed in the safe space; each component of the pavilion support is simple in structure and easy to assemble, reducing the labor intensity and improving the working efficiency by lifting the shield plate by use of the hydraulic prop. In this method, the initial supporting arch is erected under the shield plate and the structure of the pavilion support will not occupy the operation space of the initial support and secondary lining; The initial supporting arch is disposed at a proper position so that the load of the shield plate is jointly supported by the column, the bottom column, the padding plate, and the hydraulic jack and transferred to the initial supporting shed smoothly. The shield plate stays in the collapse cavity and effectively fills the collapse cavity above the initial supporting arch directly, ensuring the safety of the supporting structure. Further, the method also features strong applicability, good safety level and so on.

BRIEF DESCRIPTION OF THE DRAWINGS

FIG. 0.10 is a schematic diagram of a hydraulic prop after being lifted.

Figure 1:
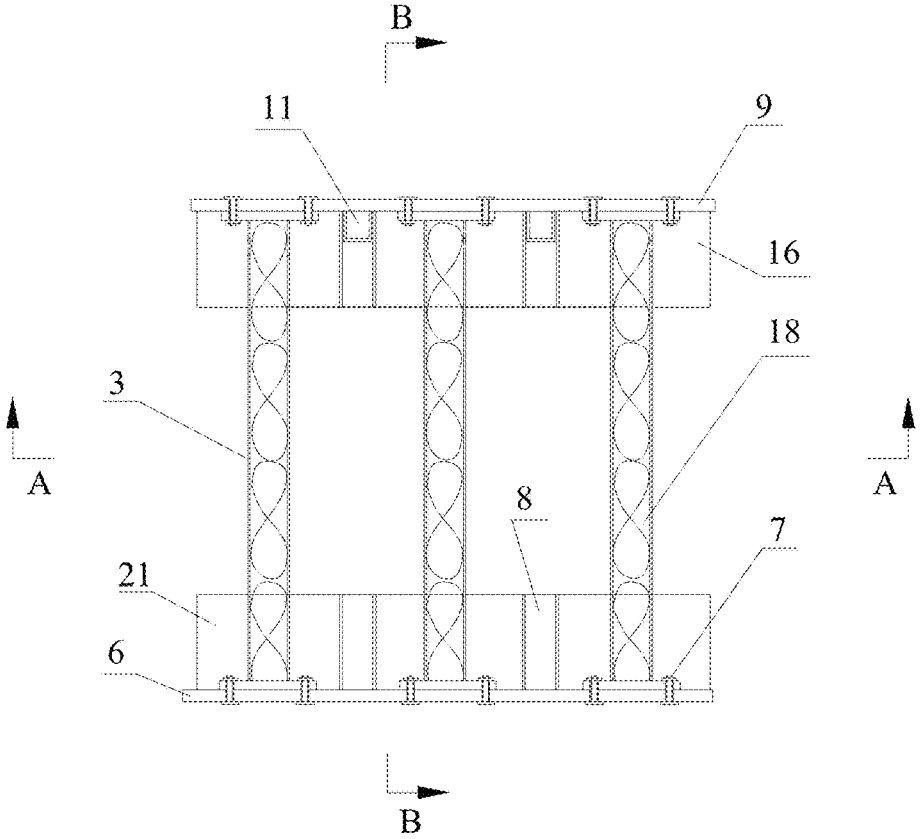
FIG. 1 is a structural schematic diagram of a pavilion shield plate support.

In the drawings, numerals of drawings are described as follows: 1—base, 2—shield plate, 3—column, 4—bottom column, 5—hydraulic prop, 6—bottom steel plate, 7—bolt, 8—bottom prop groove, 9—top steel plate, 10—longitudinal canopy, 11—transverse canopy, 12—top prop groove, 13—filling material pumping pipe penetration hole, 14—air discharge pipe penetration hole, 15—toothed groove, 16—upper rib plate, 17—lower connection plate, 18—column body, 19—upper connection plate, 20—bolt hole, 21—lower rib plate, 22—padding plate, 23—platform, 24—initial supporting arch, 25—initial supporting shed, 26—filling material pumping pipe, 27—air discharge pipe.

DETAILED DESCRIPTION OF THE EMBODIMENTS

Figure 2:
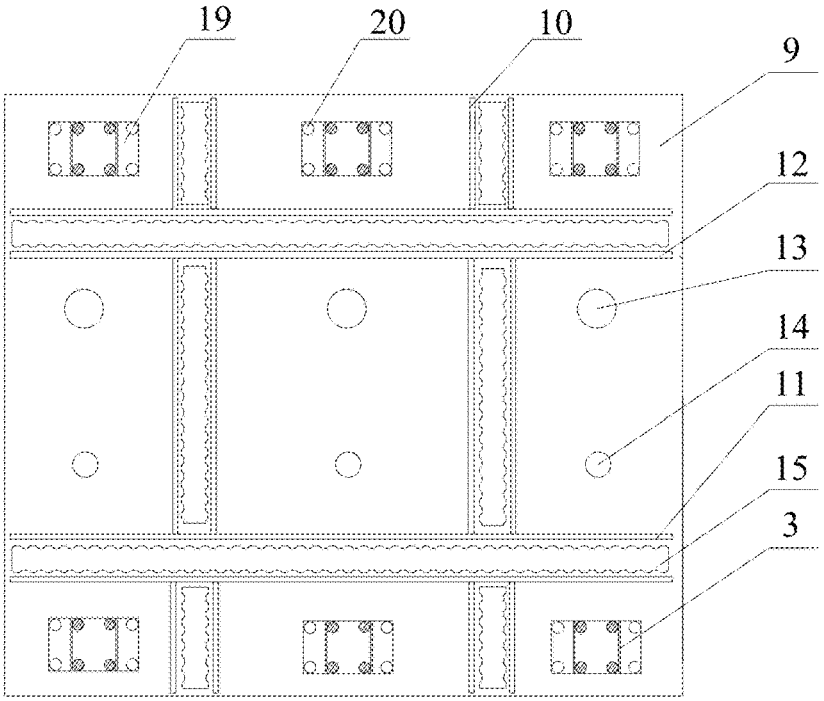
FIG. 2 is a view taken along A-A in FIG. 1.
Figure 3:
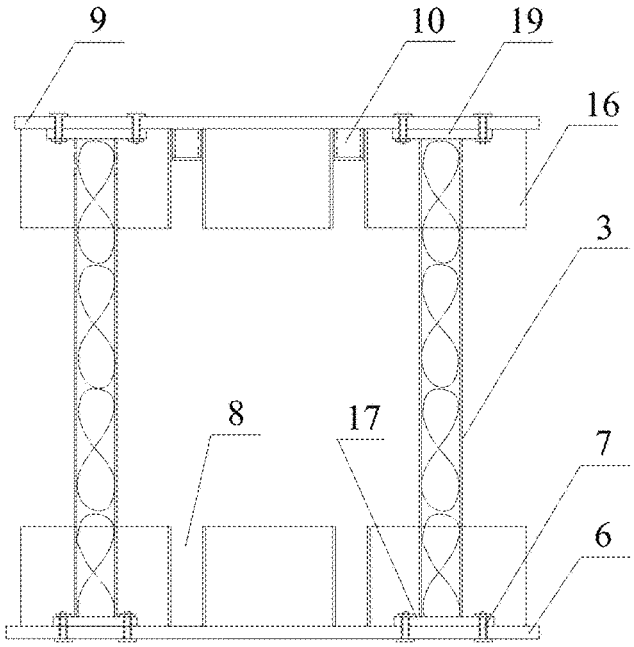
FIG. 3 is a view taken along B-B in FIG. 1
Figure 4:
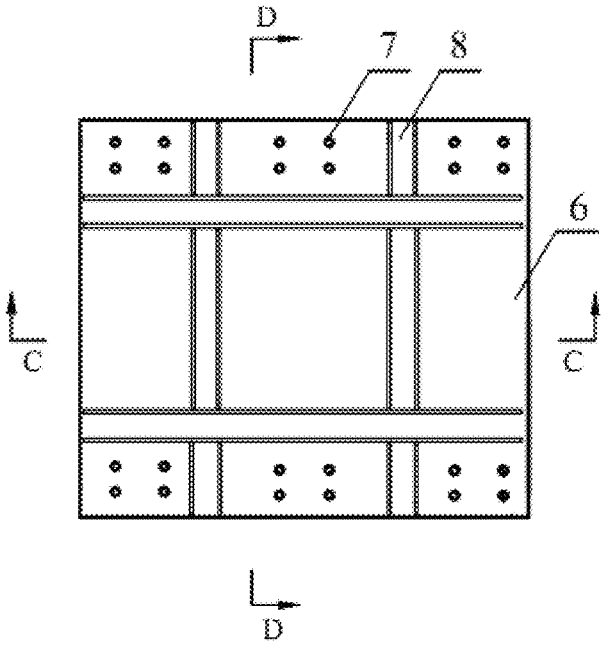
FIG. 4 is a structural schematic diagram of a base.
Figure 5:
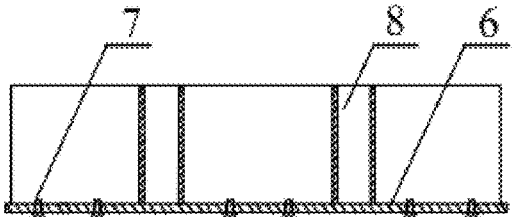
FIG. 5 is a view taken along C-C in FIG. 4.
Figure 6:
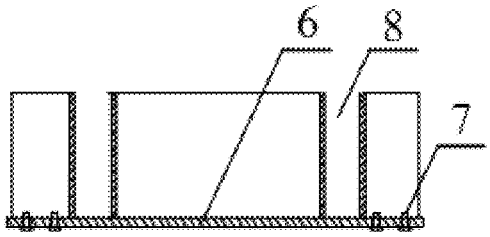
FIG. 6 is a view taken along D-D in FIG. 4.
Figure 7:
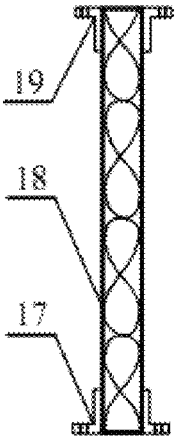
FIG. 7 is a structural schematic diagram of a column.
Figure 8:
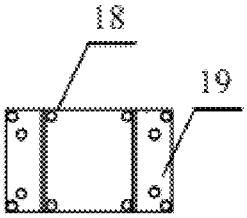
FIG. 8 is a top view of a column.
Figure 9:
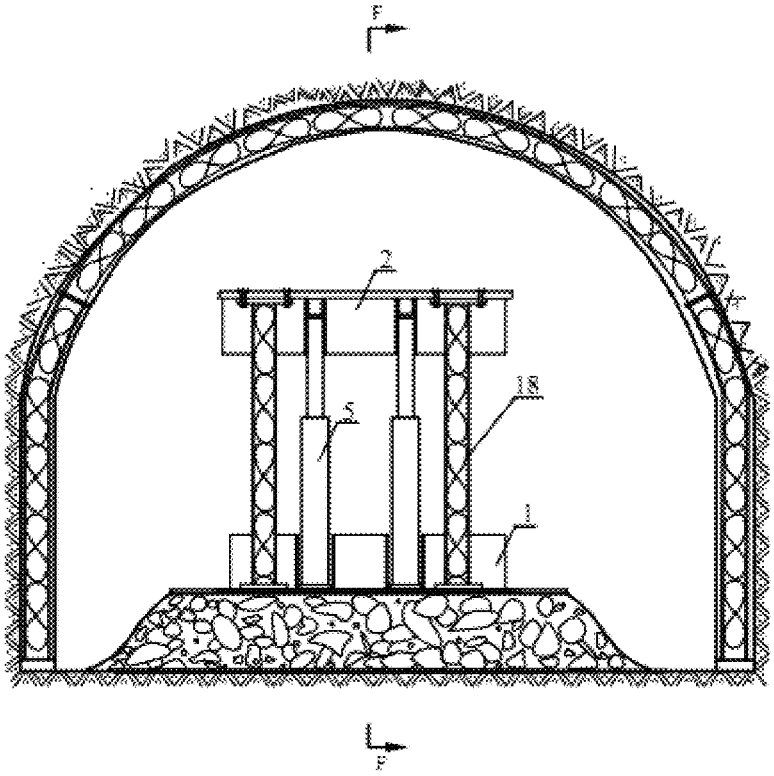
FIG. 9 is a schematic diagram of a hydraulic prop after being mounted.
Figure 10:
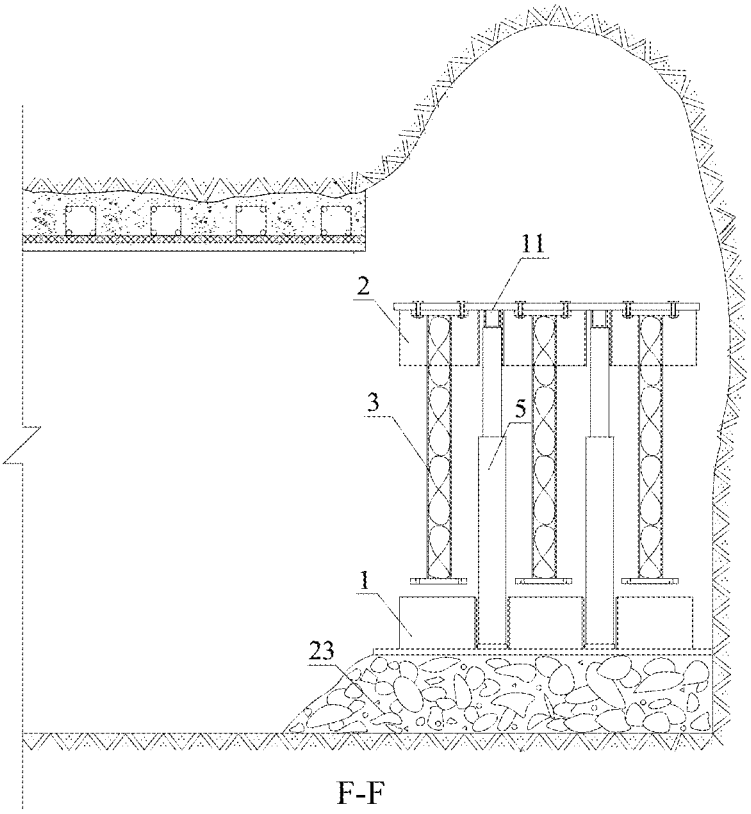
Figure 11:
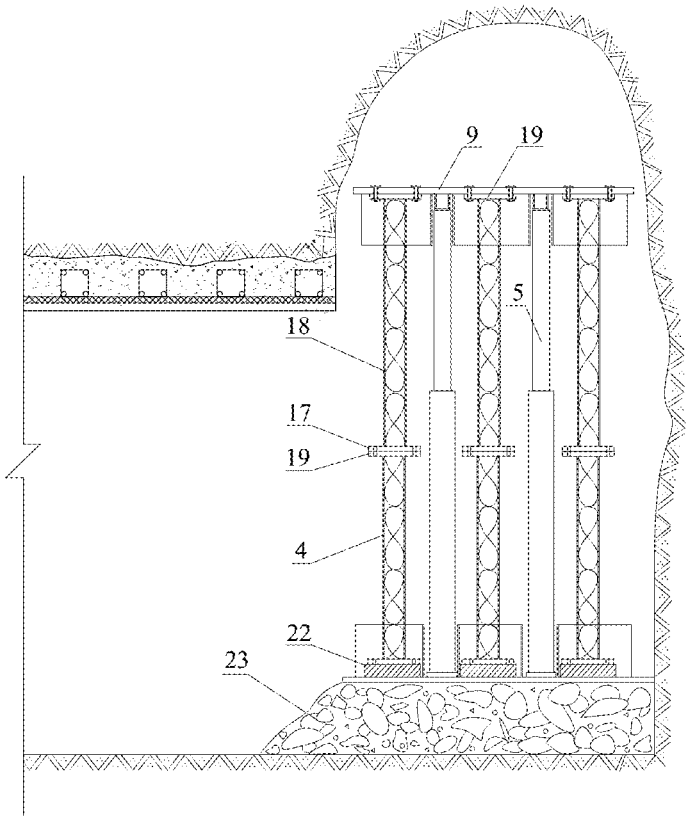
FIG. 11 is a schematic diagram of a bottom column after being mounted.
Figure 12:
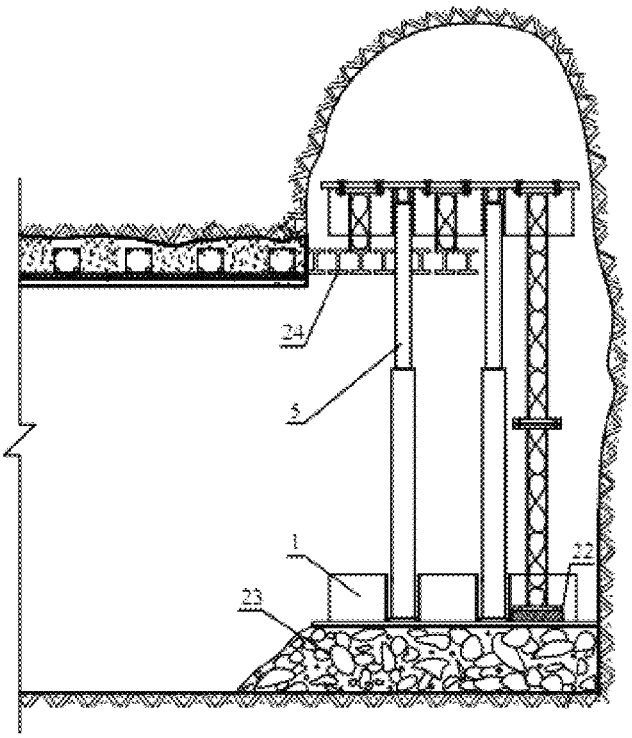
FIG. 12 is a schematic diagram of mounting of an initial supporting arch.
Figure 13:
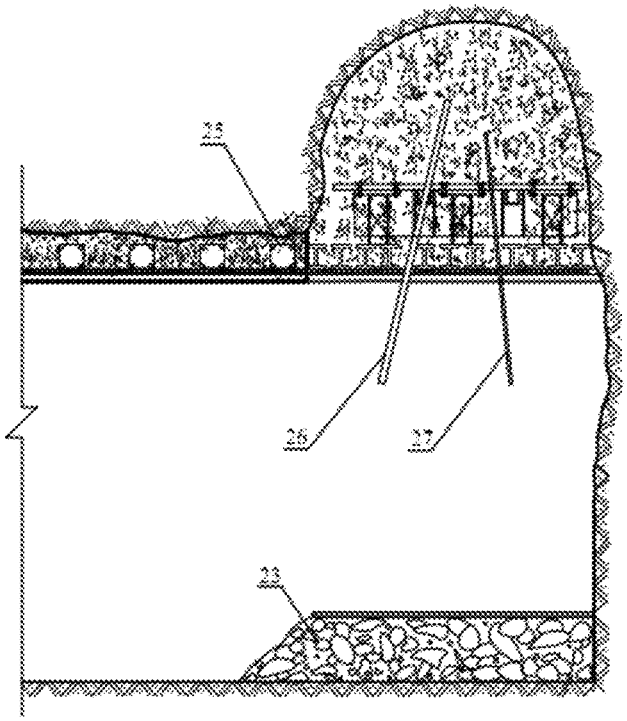
FIG. 13 is a schematic diagram of a collapse cavity filled with pumped filling material.
Figure 14:
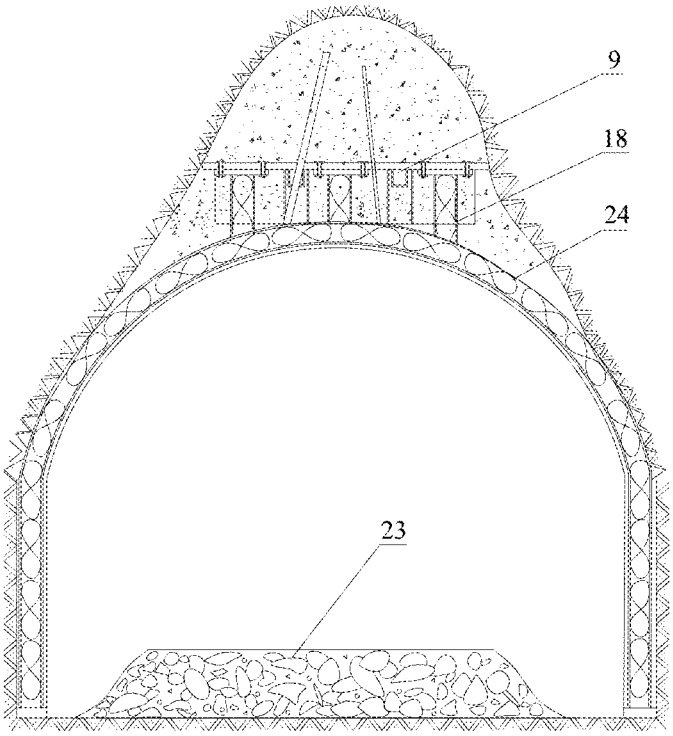
FIG. 14 is a sectional view of a tunnel after a collapse is treated.

As shown in FIGS. 1-14, the present disclosure provides a method of treating tunnel collapse using a pavilion support with its specific examples described below.

A method of treating tunnel collapse using a pavilion support is provided, which includes the following steps.

At step 1, a pavilion support structure including an assembly base 1, a shield plate 2, a column 3, a longitudinal canopy 10 and a transverse canopy 11 is mounted, where the longitudinal canopy 10 and the transverse canopy 11 are fixed on the shield plate 2, and the column 3 is fixed between the base 1 and the shield plate 2.

Specifically, a size of the shield plate 2 is selected according to a scope of collapse, the shield plate 2 is made of steel plate material and includes a top steel plate and an upper rib plate 16, the upper rib plate 16 is disposed at a lower surface of the top steel plate 9, the upper rib plate 16 forms a top prop groove 12, the longitudinal canopy 10 and the transverse canopy 11 are both mounted in the top prop groove 12 by welding or bolting. The shield plate 2 is further provided with one or more groups of penetration holes for a filling material pumping pipe 26 and an air discharge pipe 27 to pass through, and each group of penetration holes includes one filling material pumping pipe 26 penetration hole 13 and one air discharge pipe penetration hole 14. A bottom plate is used to provide a stable supporting point for the column and includes a bottom steel plate 6 and a lower rib plate 21, the lower rib plate 21 is arranged to form a bottom prop groove 8, and the bottom prop groove 8 on the base 1 is opposed in position to the longitudinal canopy 10 or the transverse canopy 11 up and down, where the lower rib plate 21 and the bottom steel plate 6 may be fixed by welding or bolt or may be made into one-piece structure.

The top steel plate 9 and the bottom steel plate 6 are connected to the upper connection plate 19 and the lower connection plate 17 of the column respectively through bolts 7. The column 3 may be made of profile steel such as steel pipe or H-steel or grid formed by welding rebars, and the longitudinal canopy 10 and the transverse canopy 11 may also be a mining-specific metal canopy. The bottom prop groove 8 on the base 1 is opposite in position to the top prop groove 12, and the longitudinal canopy 10 and the transverse canopy 11 are mounted in the top prop groove 12. The column 3 and the bottom column 4 each include the upper connection plate 19, the lower connection plate 17 and a column body 18, the upper connection plate 19 and the lower connection plate 17 which are provided with bolt holes 20 are fixed on the upper and lower ends of the column body 18 to facilitate connection. The upper connection plate 19 and the lower connection plate 17 of the column are fixed at the shield plate 2 and the base 1 respectively, the column 3 connects the base 1 and the shield plate 2 into one piece, and a safe space is provided under the shield plate 2. Because different components of the shield plate support are simple in structure and thus can be assembled outside a tunnel or in a safe position in the tunnel.

At step 2, a collapse body under a collapse cavity is leveled to form a platform 23 and the pavilion support structure is placed on the platform 23.

Gravels under the collapse cavity may be leveled by use of a long-arm machine to form the platform 23; the assembled pavilion shield plate support is then moved onto the platform by the long-arm machine. Alternatively, the gravels may also be leveled by the long-arm machine to form the platform 23, and then the pavilion support structure is fixed on a motor vehicle which is then driven onto the platform under the collapse cavity with a driver cab of the motor vehicle and a hydraulic operation system being in a safe region outside the collapse cavity, and then the pavilion support is placed under the collapse cavity.

At step 3, under the protection of the shield plate 2, hydraulic props 5 are inserted into the bottom prop grooves 8 on the base 1, and the hydraulic props are lifted to enable each hydraulic prop 5 to be fitted with the longitudinal canopy 10 and the transverse canopy 11.

The structure of the bottom prop groove 8 may also be another form easily fixing the hydraulic prop, and the structure of the top prop groove 12 may also be another form easily fixing the top cover of the hydraulic prop. The hydraulic prop 5 may be a single hydraulic prop or a hydraulic jack, and the bottom of the hydraulic prop 5 may also be fixed in the bottom prop groove 8 on the base by pin or insertion plate, the top of the hydraulic prop 5 is fitted with a toothed groove 15 on the he longitudinal canopy 10 or the transverse canopy 11. Thus, the integrity and stability of the hydraulic prop can be guaranteed better.

At step 4, the column 3 and the base 1 are disconnected, and the smooth lifting of the hydraulic prop 5 is continued until a lower edge of the top prop groove 12 is higher than a contour line of an initial supporting arch.

After the column 3 and the base 1 are disconnected, the shield plate 2 and the upper connection plate 19 of the column are still in connection and moved up along with the hydraulic prop 5. This process usually lasts for a short period of time and the operation is performed under the roof, thereby ensuring operation safety.

At step 5, a bottom column 4 is mounted, the lower connection plate 17 of the column and the upper connection plate 19 of the bottom column are firstly fixedly connected and then a padding plate 22 is inserted between the bottom column 4 and the base 1.

The padding plate 22 is a wooden padding plate, and a padding plate space of 30 mm-250 mm is reserved between the bottom column 4 and the bottom steel plate 6. After the padding plate 22 is inserted, a spacing of 1 mm-50 mm is kept between the padding plate 22 and the lower connection plate 17 of the bottom column. When the hydraulic prop 5 retracts under load, the column 3, the bottom column 4, the padding plate 22 and the hydraulic prop 5 will jointly bear a load from the shield plate. Under the action of the wooden padding plate, each bottom column can receive a force in a balanced way. In this case, it is avoided that when the hydraulic prop 5 receives an increased pressure at the instant of collapse, the hydraulic oil of the hydraulic prop 5 cannot be discharged in time, resulting in cylinder explosion. Further, the wooden padding plate optimizes contact type between the bottom column 4 and the base 1, ensuring balanced force on each column, and preventing stress concentration problem resulting from point or line contact between the bottom column 4 and the base 1.

At step 6, an initial supporting arch 24 is erected under the shield plate 2 and connected with an original supporting structure in the tunnel to form an initial supporting shed 25. The original supporting structure in the tunnel may include an original initial supporting shed, an anchor bolt, an anchor cable, an anchor net and the like. The initial supporting arch 24 refers to a single arch, and the initial supporting shed 25 refers to a supporting body structure formed of a plurality of initial supporting arches 24. After the initial supporting shed 25 is formed, the load of the shield plate is transferred from the pavilion support to the initial supporting shed 25, where the load of the shield plate includes a dead weight of the shield plate, a collapse body possibly collapsing from the collapse cavity, and filling material pumped to the collapse cavity. Therefore, in this method, the single hydraulic prop 5 can be easily removed, ensuring the safety of working process.

When the hydraulic prop 5 occupies a mounting position of the initial supporting arch 24, an alternative hydraulic prop is firstly erected at the position adjacent to the hydraulic prop 5 and the hydraulic prop 5 occupying the mounting position of the initial supporting arch 24 is then dismounted. After dismounting, the initial supporting arch 24 is mounted at the position.

When the column 3 occupies a mounting position of the initial supporting arch 24, the column 3 and an adjacent initial supporting arch 24 are welded together. When the column 3 is not overlapped with the adjacent initial supporting arch 24, the column 3 and the adjacent initial supporting arch 24 may be welded together by use of a metal member, and then a part of the column 3 invading into the initial supporting arch 24 is cut off. Afterwards, the initial supporting arch 24 is erected at the position of cutting of the column 3, and then the cutting point of cutting the column and the below initial supporting arch 24 are welded together. After the initial supporting shed 25 is formed, the load of the shield plate is transferred from the pavilion support to the initial supporting shed 25.

At step 7, the hydraulic prop 5 is removed, then an air discharge pipe 27 and a filling material pumping pipe 26 are mounted on the shield plate 2 and an anchor net is laid under the initial supporting arch 24.

Specifically, the hydraulic prop 5 and the alternative hydraulic prop 5 are removed, and then the base 1 is removed. Afterwards, the filling material pumping pipe 26 and the air discharge pipe 27 are mounted. The filling material pumping pipe 26 can be inserted at an inclination angle with its slurry discharge position made close to the top of the collapse cavity as possible. The anti-clogging top cover may be disposed at the end of the air discharge pipe and the air discharge pipe is protruded to furthest above the collapse cavity as possible.

At step 8, concrete is sprayed onto the initial supporting arch 24, filling material is pumped into the collapse cavity after setting of the concrete, and the air discharge pipe discharges air in the collapse cavity until the collapse cavity is filled up with filling material. The filling material may be an inorganic or organic filling material such as concrete, foamed concrete, and Marithan.

A fast-setting concrete may be sprayed on the initial supporting arch 24. After spraying of the concrete, a closed shell is formed on the initial supporting arch 24. After the closed shell is formed, the air discharge pipe is protruded into the top of the collapse cavity, and an outlet height of the filling material pumping pipe 26 is smaller than a height of a port of the air discharge pipe. After concrete is sprayed onto the initial supporting arch 24 to form the closed shell, concrete is then pumped into the collapse cavity and the air discharge pipe discharges air in the collapse cavity until the collapse cavity is filled up with concrete.

Various steps of the method are performed in a safe space and thus can be applied to treatment of relatively stable collapse of a collapse cavity, and especially to the treatment of a high collapse cavity where the conventional support devices cannot contact the roof normally. The hydraulic prop, the column and the bottom column jointly perform supporting, the rigid supporting of the column and the bottom column ensures the safety when the hydraulic prop receives instantaneous high-strength impact, and the single hydraulic prop can apply an active supporting force to the shield plate to reduce the load acting on the column and the bottom column. When the load of the collapse body increases, the number of the single hydraulic props can be increased according to requirements. Thus, the supporting capacity of the shield plate support can be guaranteed. In this method, the initial supporting arch can be arranged at a proper position, and the structure of the shield plate of the pavilion support abandoned above the initial supporting shed will not occupy the operation space of the initial support and secondary lining. Thus, the load of the shield plate is jointly supported by the column, the bottom column, the padding plate, and the hydraulic jack and transferred to the initial supporting shed smoothly. Further, this method can effectively perform filling to the collapse cavity above the initial supporting arch, eliminating the potential safety hazard resulting from continued collapse of the collapse cavity.

Of course, the above descriptions are not intended to limit the present disclosure and the present disclosure is not limited to these above examples. Any change, modifications, additions or substitution made by those skilled in the art within the essence scope of the present disclosure shall all fall within the scope of protection of the present disclosure.

The invention claimed is:

1. A method of treating tunnel collapse using a pavilion support, comprising the following steps:

at step 1, mounting a pavilion support structure, comprising an assembly base, a shield plate, a column, a longitudinal canopy, and a transverse canopy, wherein the longitudinal canopy and the transverse canopy are fixed on the shield plate, and the column is fixed between the base and the shield plate;

at step 2, leveling a collapse body under a collapse cavity to form a platform, and placing the pavilion support structure on the platform;

at step 3, inserting a plurality of hydraulic props into a bottom prop groove on the base under the protection of the shield plate, lifting the plurality of hydraulic props to enable each hydraulic prop of the plurality of hydraulic props to be fitted with the longitudinal canopy or the transverse canopy;

at step 4, disconnecting the column and the base, and continuing lifting the plurality of hydraulic props smoothly until a lower edge of a top prop groove is higher than a contour line of an initial supporting arch;

at step 5, mounting a bottom column, firstly fixing a lower connection plate of the column and an upper connection plate of the bottom column and then inserting a padding plate between the bottom column and the base;

at step 6, erecting the initial supporting arch under the shield plate, and fixedly connecting an original supporting structure in a tunnel and the initial supporting arch under the shield plate to form an initial supporting shed;

at step 7, removing the plurality of hydraulic props, mounting an air discharge pipe and a filling material pumping pipe on the shield plate, and laying an anchor net under the initial supporting arch;

at step 8, spraying concrete onto the initial supporting arch, and after setting of the concrete, pumping a filling material into the collapse cavity and discharging air in the collapse cavity with the air discharge pipe until the collapse cavity is filled up with the filling material.

2. The method of treating tunnel collapse using a pavilion support according to claim 1, wherein in step 1, the top prop groove is disposed on the shield plate and the bottom prop groove is disposed on the base, the top prop groove and the bottom prop groove are oppositely disposed; the longitudinal canopy and the transverse canopy are mounted in the top prop groove; and the longitudinal canopy and the transverse canopy each are provided with a toothed groove engaged with a top cover of the plurality of hydraulic props.

3. The method of treating tunnel collapse using a pavilion support according to claim 2, wherein one or more groups of penetration holes are disposed on the shield plate, each group of penetration holes includes one filling material pumping pipe penetration hole and one air discharge pipe penetration hole; a bottom plate is provided with a bolt for mating with a bolt hole on the lower connection plate of the column.

4. The method of treating tunnel collapse using a pavilion support according to claim 1, wherein at step 2, leveling the collapse body under the collapse cavity by an excavator, and moving the pavilion support structure onto the platform by the excavator; or, fixing the pavilion support structure on a motor vehicle which then driving the motor vehicle onto the platform under the collapse cavity with a driver cab of the motor vehicle being in a safe region outside the collapse cavity.

5. The method of treating tunnel collapse using a pavilion support according to claim 1, wherein at step 3, selecting a single hydraulic prop or a hydraulic jack as one of the plurality of hydraulic props, fixing the bottom of the selected single hydraulic prop in the bottom prop groove of the base by a pin or insertion plate, and fitting the top of the selected single hydraulic prop with a toothed groove of the longitudinal canopy or the transverse canopy.

6. The method of treating tunnel collapse using a pavilion support according to claim 5, wherein in step 6, when the selected single hydraulic prop occupies a mounting position of the initial supporting arch, an alternative hydraulic prop is firstly erected at a position adjacent to the selected single hydraulic prop occupying the mounting position and the hydraulic prop occupying the mounting position of the initial supporting arch is then dismounted.

7. The method of treating tunnel collapse using a pavilion support according to claim 6, wherein when the column occupies a mounting position of the initial supporting arch, the column and an adjacent initial supporting arch are welded together and a part of the column invading into the initial supporting arch is cut off, and then the initial supporting arch is then erected at the position of cutting the column, and the cutting point of cutting off the column and the initial supporting arch are welded together; and after the initial supporting shed is formed, transferring the load of the shield plate from the pavilion support to the initial supporting shed.

8. The method of treating tunnel collapse using a pavilion support according to claim 1, wherein in step 4, after the column and the base are disconnected, the shield plate and the upper connection plate of the column are still in connection and moved up along with the plurality of hydraulic props.

9. The method of treating tunnel collapse using a pavilion support according to claim 1, wherein in step 5, after the padding plate is inserted, when the plurality of hydraulic props retract under load, the column, the bottom column, the padding plate and the plurality of hydraulic props jointly bear a load transferred from the shield plate.

10. The method of treating tunnel collapse using a pavilion support according to claim 1, wherein a side baffle plate is disposed at a side wing of the shield plate and hinged with the shield plate, and the side baffle plate is movable with the help of the supporting of the plurality of hydraulic props on the shield plate or the base.

* * * * *